US006860707B2

(12) United States Patent
Roan et al.

(10) Patent No.: US 6,860,707 B2
(45) Date of Patent: Mar. 1, 2005

(54) SUPPORT FRAME STRUCTURE FOR LOADER LIFT ARMS

(75) Inventors: Thomas J. Roan, Augusta, GA (US); Larry E. Albright, Gwinner, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 10/318,001

(22) Filed: Dec. 12, 2002

(65) Prior Publication Data

US 2004/0115036 A1 Jun. 17, 2004

(51) Int. Cl.[7] ..... B66C 3/00
(52) U.S. Cl. ..... 414/723; 37/468
(58) Field of Search ..... 414/680, 685, 414/722, 723, 718; 37/468; 52/111, 116, 118; 180/89.14, 89.16

(56) References Cited

U.S. PATENT DOCUMENTS

| | | | | | |
|---|---|---|---|---|---|
| 2,790,568 | A | | 4/1957 | Mandt | 214/132 |
| D205,485 | S | | 8/1966 | Juhl et al. | D14/3 |
| 3,400,767 | A | | 9/1968 | Hermiz | 172/805 |
| 4,046,026 | A | | 9/1977 | Hammarstrand | 74/519 |
| D247,814 | S | | 5/1978 | Johnson et al. | D15/23 |
| 4,143,783 | A | | 3/1979 | Cochran et al. | 414/715 |
| 4,355,946 | A | | 10/1982 | Wykhuis et al. | 414/707 |
| 4,401,179 | A | * | 8/1983 | Anderson | 180/89.14 |
| 4,576,543 | A | * | 3/1986 | Kuchyt et al. | 414/722 |
| 4,812,103 | A | | 3/1989 | Cochran et al. | 414/723 |
| 4,824,319 | A | | 4/1989 | Arnold | 414/723 |
| 4,850,790 | A | | 7/1989 | Johnson et al. | 414/723 |
| D314,389 | S | | 2/1991 | Lynnes et al. | D15/25 |
| 4,999,022 | A | * | 3/1991 | Veys | 414/718 |
| D322,792 | S | | 12/1991 | Park | D15/25 |
| 5,111,578 | A | * | 5/1992 | Ball et al. | 414/722 X |
| 5,403,144 | A | | 4/1995 | Staben, Jr. | 414/697 |
| D364,408 | S | | 11/1995 | Bryant et al. | D15/25 |
| 5,562,397 | A | | 10/1996 | Albright | 414/723 |
| D376,372 | S | | 12/1996 | Little et al. | D15/23 |
| 5,590,483 | A | | 1/1997 | Kim | 37/468 |
| 5,807,061 | A | | 9/1998 | Donoghue et al. | 414/710 |
| 5,820,332 | A | | 10/1998 | Philips et al. | 414/723 |
| D406,594 | S | | 3/1999 | Miller et al. | D15/31 |
| D407,415 | S | | 3/1999 | Flatau et al. | D15/28 |
| D407,416 | S | | 3/1999 | Miller et al. | D15/28 |
| D407,418 | S | | 3/1999 | Miller et al. | D15/28 |
| 5,941,330 | A | | 8/1999 | Miller et al. | 180/89.15 |
| D419,568 | S | | 1/2000 | Baig et al. | D15/25 |
| D423,521 | S | | 4/2000 | Walter et al. | D15/23 |
| D428,425 | S | | 7/2000 | Ratcliffe | D15/23 |
| 6,098,739 | A | | 8/2000 | Anderson et al. | 180/312 |

OTHER PUBLICATIONS

Advertising Publication of Daewoo Heavy Industries & Machinery Ltd., published at least as early as Aug. 14, 2001.

* cited by examiner

*Primary Examiner*—Donald W. Underwood
(74) *Attorney, Agent, or Firm*—Westman, Champlin & Kelly, P.A.

(57) ABSTRACT

A lift arm assembly has a pair of lift arms that are pivotally mounted onto the frame of a loader that has a forwardly pivoting cab. The forward ends of the lift arms each have a front frame assembly that is secured to the respective lift arm. The front frame assemblies includes separate box section frames with depending leg portions that have pivots at lower ends thereof for supporting attachments for the loader. The upper ends of the box section frames have sockets that receive the lift arms. The depending portions are offset inwardly from the lift arms, and tilt cylinders for controlling the pivoting of attachments are mounted on the depending portions to align with connections for loader attachments while providing clearance above the depending portions for forward pivoting of the cab. The depending portions are secured together with a torsion resisting cross member adjacent the lower ends to provide rigidity to the lift arm assembly.

11 Claims, 10 Drawing Sheets

SUPPORT FRAME STRUCTURE FOR LOADER LIFT ARMS

CROSS REFERENCE TO RELATED APPLICATION

Reference is made to U.S. patent application Ser. No. 10/123,469, filed Apr. 15, 2002 for Telescoping Loader Lift Arm, the contents of which is incorporated by reference.

BACKGROUND OF THE INVENTION

The present invention relates to a front end lift arm frame structure for loader lift arms that includes separate front end frames on lift arms that are spaced to provide clearance between the forward ends of the lift arms and a forward pivoting cab. The front end frames mount a pair of tilt cylinders, one on each frame, in alignment with pivot hubs for an attachment plate that are spaced at the standard with. The front end frames are secured to the ends of the lift arms and then are offset inwardly, toward a loader center line to mount tilt cylinders in the desired position. The front end frames are joined with a rigid cross tube at their lower ends. The front end frames are used on either telescoping or fixed length lift arms.

The lift arms on front end loaders are the load carrying supports and must be rigid and of adequate strength. Forward visibility is important, and since buckets and grapples need to be tilted in use, mounting tilt cylinders at the front end is necessary. The spacing of the tilt cylinders and the pivotal mounting hubs should match the spacing of existing attachments plates. When a forward pivoting cab is used, clearance for the width of the cab must be provided and near the top of the front frame on the lift arms.

Telescoping lift arms are used in connection with bucket loaders or similar earth working equipment. In the case of skid steer loaders, it is necessary to have hydraulic controls for tilt cylinders and front mounted accessories, such as those which require hydraulic motors, or hydraulic cylinder actuators. A valve can be mounted on a support extending between the front end frames and provided with hydraulic fluid under pressure from the loader mounted pump.

SUMMARY OF THE INVENTION

The present invention relates to a lift arm assembly that has individual lift arms on which front end support frames for supporting buckets and other tools or accessories are mounted. The separate end frame members on the front ends of the lift arm tubes are spaced apart at their upper ends to provide clearance for a forward pivoting loader cab. The lower portions of the front frames are set inwardly from the lift arm center to provide for mounting front attachment tilt cylinders for tilt control of an attachment plate at a standard spacing. The offset also permits locating the tilt cylinders aligned with the center of the pivot pins used for a standard attachment plate. The front frame members are connected with a cross tube to form a lift arm assembly.

The first form of the front end frame assembly, as shown, is used with lift arm tubes that telescope on main lift arm support housings. The lift arm tubes can be extended and retracted utilizing hydraulic actuators on the interior of the support housings and lift arm tubes. A second form shows fixed length lift arms which use the front end frames.

The front end frames in both forms of the invention are secured to the outer end of the lift arms tubes with sockets on the front end frame members that receive the respective lift arm tube. The front end frame members have legs that depend downwardly from the lift arms and are offset inwardly at a level below the lift arms so the cab can pivot or tilt forwardly with the lift arms lowered. The forward pivoting cab provides full access to an engine and other power equipment at the rear of the cab. The front end frames have box cross sections and form properly spaced, and mounts for tilt cylinders or actuators that will tilt buckets and auxiliary attachments mounted onto a provided front attachment plate.

A tubular cross member extends between the two front end frame members at a lower end of the front end frame depending legs. The lift arm tubes (that may telescope in and out of the lift arms) are thus held rigidly. The rigidity of the forward ends of the lift arm assembly is achieved without complex forming of metal tubes, and the front end frames provide stable, rigid mounts for the bucket tilt cylinders. Brackets holding a cross member for supporting a valve between the end frame members are also provided.

In one form, the box section front end frame members provide protection of the tilt cylinders and other structure used in connection with the tilting of an attachment plate or attachment.

DETAILED DESCRIPTION OF THE PREFERRED EMBODIMENTS

Figure 1:
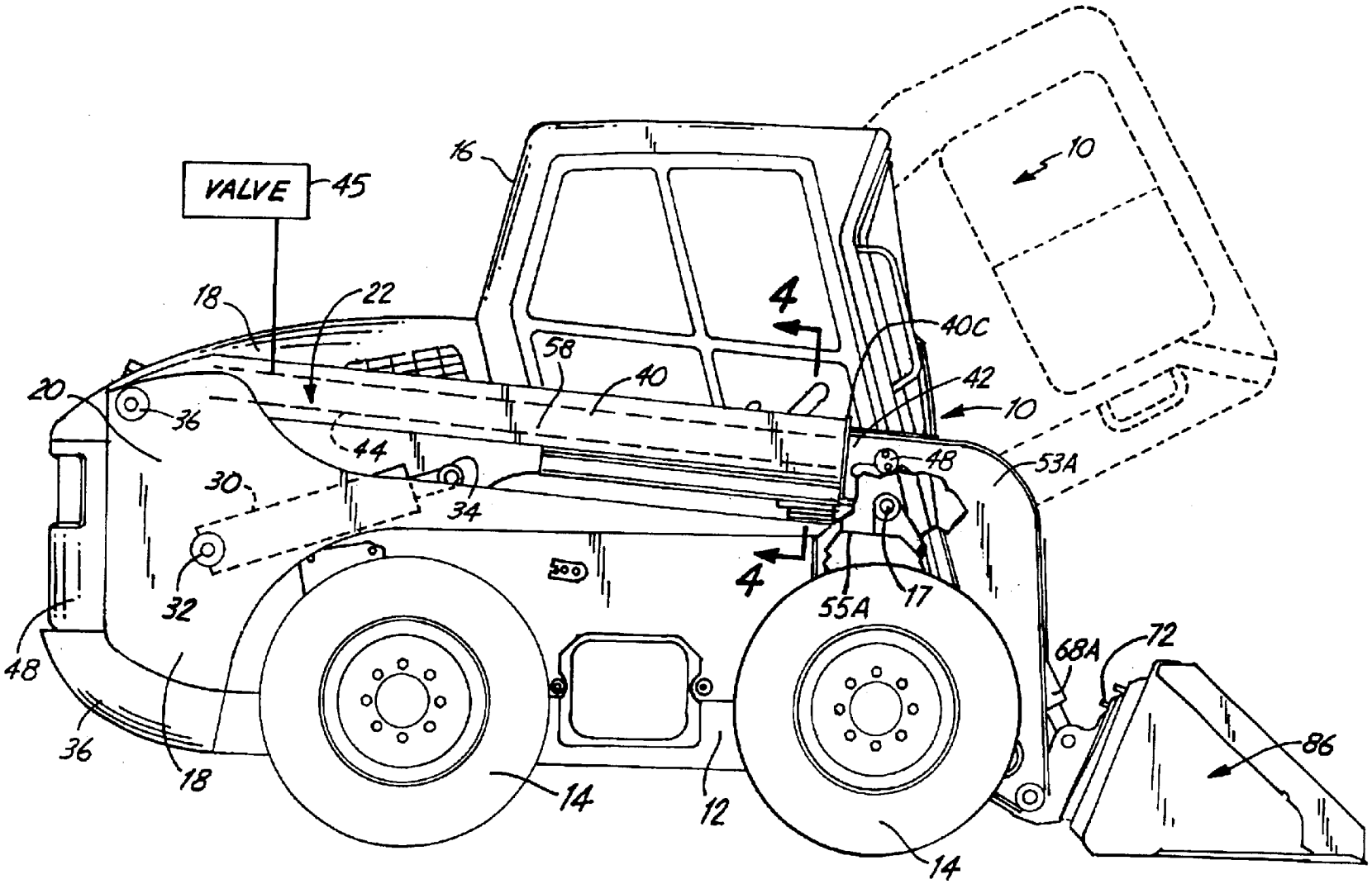
FIG. 1 is schematic side elevational view of a skid steer loader with a forwardly pivoting cab and loader lift arms having a front end frame assembly made according to a first form of the present invention.

FIG. 1 is a schematic representation of a skid steer loader 10 that has a main frame 12, and drive wheels 14 for propelling the loader across the ground. Frame 12 supports a forwardly pivoting operator's cab 16 that is mounted on pivots 17 on opposite sides of the frame 12. The cab 16 can be latched in its working position, and when the latch is released, it can be pivoted to its dotted line position for access to components in an engine compartment 18 for housing the engine for providing power to various components including lift arm cylinders 30. The cab can be retained in its open, dotted line position in a suitable manner.

Figure 2:
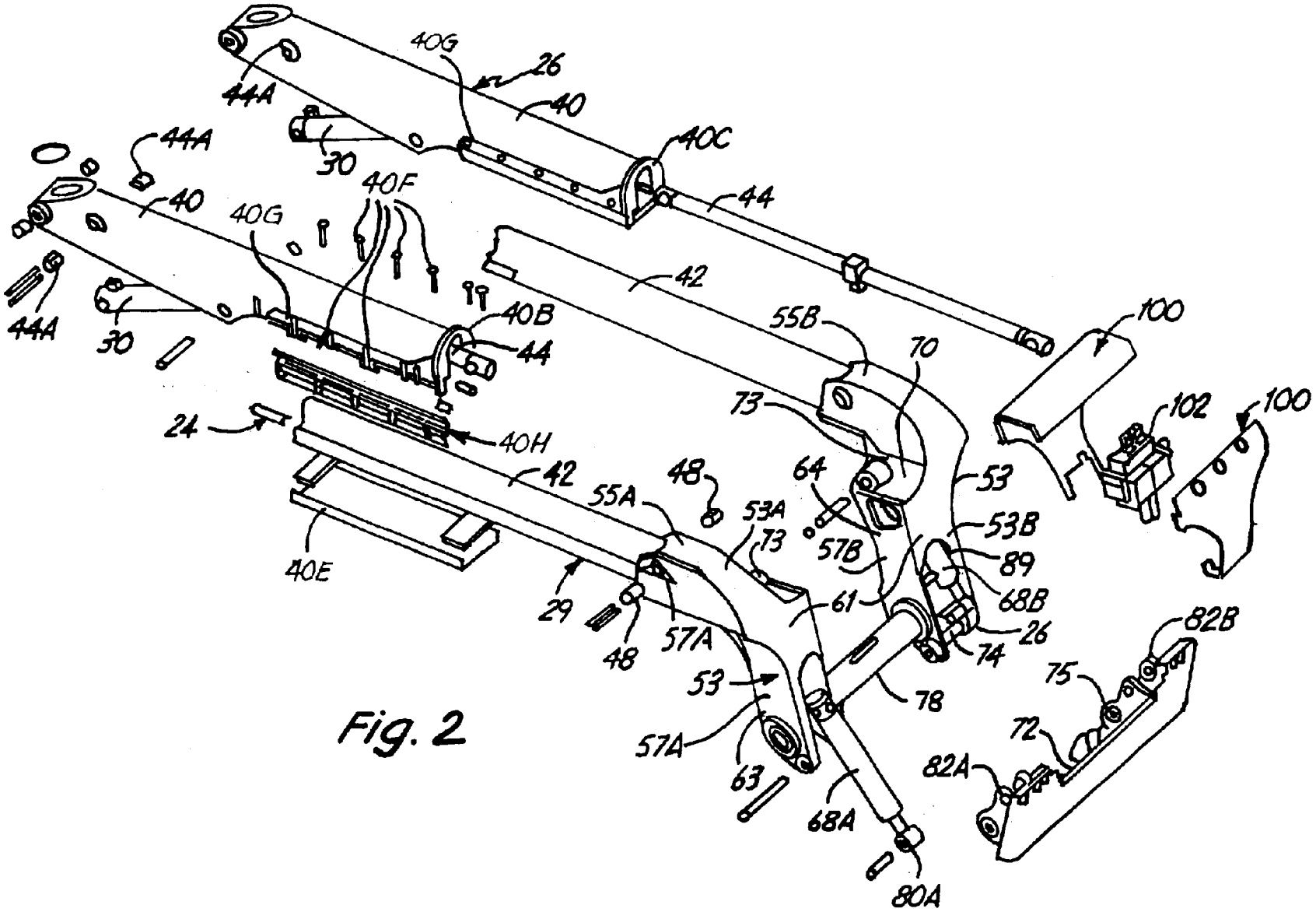
FIG. 2 is an exploded perspective view of a pair of lift arms shown in FIG. 1 in an assembly utilizing the front end frames of the present invention.
Figure 3:
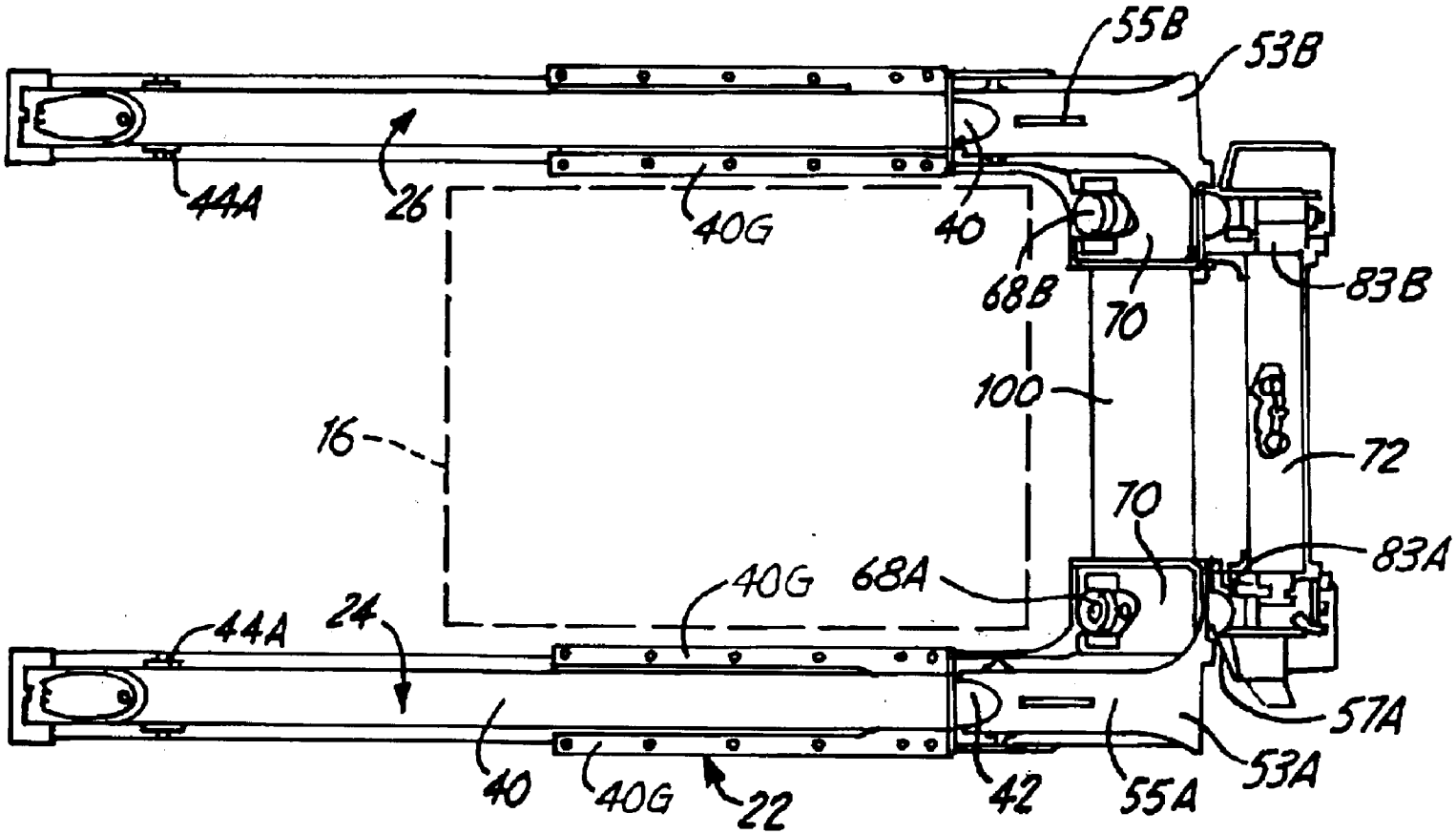
FIG. 3 is top plan view of the lift arm arrangement of FIG. 2 shown in an assembled position with a cab dotted in for illustrative purposes.

The lift arm cylinders have ends supported on lift arm support uprights or frame members 20 on which a telescoping lift arm assembly 22, shown in the first form of the present invention, is pivotally mounted. Pivots 36 are used for mounting the lift arm assembly 22 for raising and lowering a front end attachment plate 72 that can have a bucket 82 mounted thereon, as can be seen in FIGS. 2 and 3. Lift arm assembly 22 includes separate lift arms 24 and 26 that are pivotally mounted on opposite sides of the operator's cab.

The lift arm actuators or cylinders 30 used for pivoting the lift arm assembly 22 have rod ends mounted on pivots 34 to the individual arms 24 and 26 of lift arm assembly 22, and the base of each of the actuators 30 is mounted to the frame of skid steer loader at a pivot 32. In operation, the lift arm assembly 22 can be raised and lowered by operating the cylinders 30 to extend and retract in a conventional manner.

The two lift arms 24 and 26 are identical except that one is on the right hand side and the other is on the left hand side of the loader. In the form shown, the lift arm assembly 22 is a telescoping lift arm assembly, with inner lift arm tubes 42 held in an outer complimentary shaped outer lift arm tubes 40. The inner arm tubes 42 are extended and retracted by operating hydraulic actuators 44 that are shown only schematically and are representative of the types of actuators that can be used for telescoping movement of the inner lift arm tubes.

The telescoping inner lift arm tubes 42 form an assembly 29, that is held together with a main cross member 78 at a forward end thereof, as shown in FIGS. 2 and 3. The assembly 29 of the inner lift arm tubes 42 is moved as a unit through the use of the double acting actuators 44 on the interior of the telescoping inner lift arms housings or tubes 40. The base ends of the actuators 44 are mounted to the outer lift arm housings or tubes 40 on pins 44A, so that the actuators 44 move up and down with the outer lift arm tubes 40. Each actuator 44 has a rod end pivotally connected with a pin 48 to the inner lift arm tubes 42 on their respective side, so that upon extending and retracting the actuators or cylinders 44 with a suitable valve 45, the inner lift arm tubes 42 can be extended and retracted as desired.

The inner lift arm tubes slidably fit into the outer lift arm tubes 40, and can be held in place with a bottom plate 40, bolted with bolts 40E onto flange 40G on the lower edges of the outer lift arm tube. The bottom plate can be shimmed with shims 40H. This construction is described in application Ser. No. 10/123,469, filed Apr. 15, 2002, and incorporated by reference.

The telescoping arm assembly 29 is provided with front end lift arm frames 53A and 53B. The front end lift arm frames are made to be strong structural members that are fixed to and depend from the lift arm tubes 42. The front end lift arm frames have socket upper ends 55A and 55B that receive the outer ends of the inner lift arm tube sections 42. The inner lift arm tubes are securely welded or otherwise secured to the front end lift arm frames. The front end lift arm frames support hub members 47 for receiving the pins 48 that hold the rods of cylinder 44. The hub members 47 provide adequate anchors for the rod ends of the cylinders 44 for extending and retracting the inner lift arm tubes.

Since the cab 16 pivots forwardly, in order to provide an adequate opening for service of the components under the cab and in the engine compartment, the cab must pivot far enough so that it would interfere with the front end frame members, if the front frame members had their upper ends aligned with the tilt cylinder mounting on the attachment plate controlled by these tilt cylinders. The front portion of the cab will extend below the lift arms. This means that there cannot be a front cross member at the upper ends of the front frame members, and further it also means that the tilt cylinders cannot be extend upwardly so as to interfere with the cab when the cab is in its forwardly tilted position.

The tilting attachment plate 72, which is used for attaching various accessories or attachment such as bucket 86, and other components, has a standard bracket arrangement for connection to lift arms through suitable hubs, and also for connection of the tilt cylinders which control tilting of the attachment plate about its pivotal connection.

Figure 4:
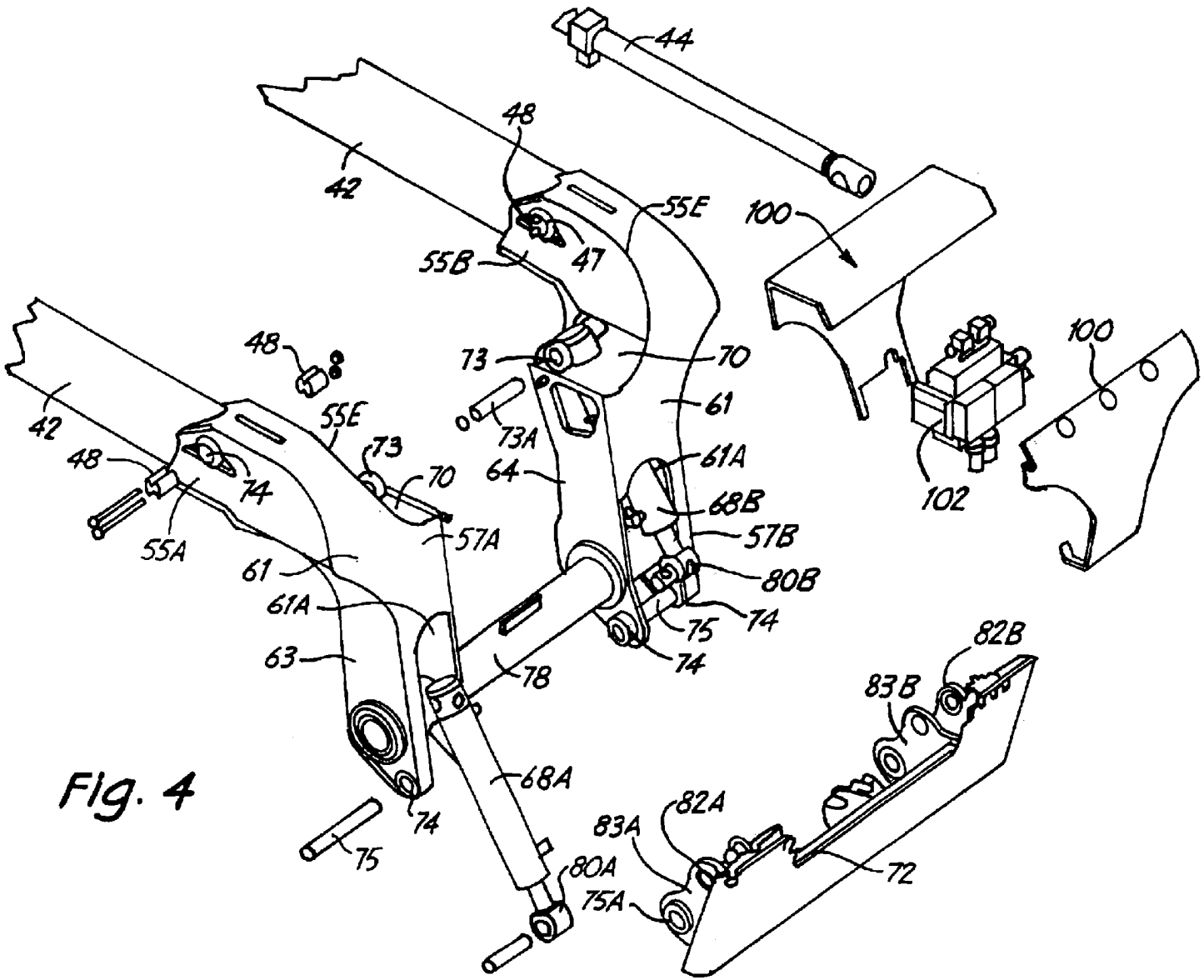
FIG. 4 is an enlarged exploded perspective view of the front end frame assembly of FIG. 3 of the present invention.

As can be seen, the socket upper ends 55A and 55B of the front end frames are centered on the central axes of the lift arm tubes, and as can be seen in FIG. 4 for example. These sockets extend downwardly as well as forwardly. The sockets have inner side edges 55E that provide clearance for the forward pivoting cab down to a level of the mounting pivots or trunions 73 for the tilt cylinders that are shown at 68A and 68B.

Figure 5:
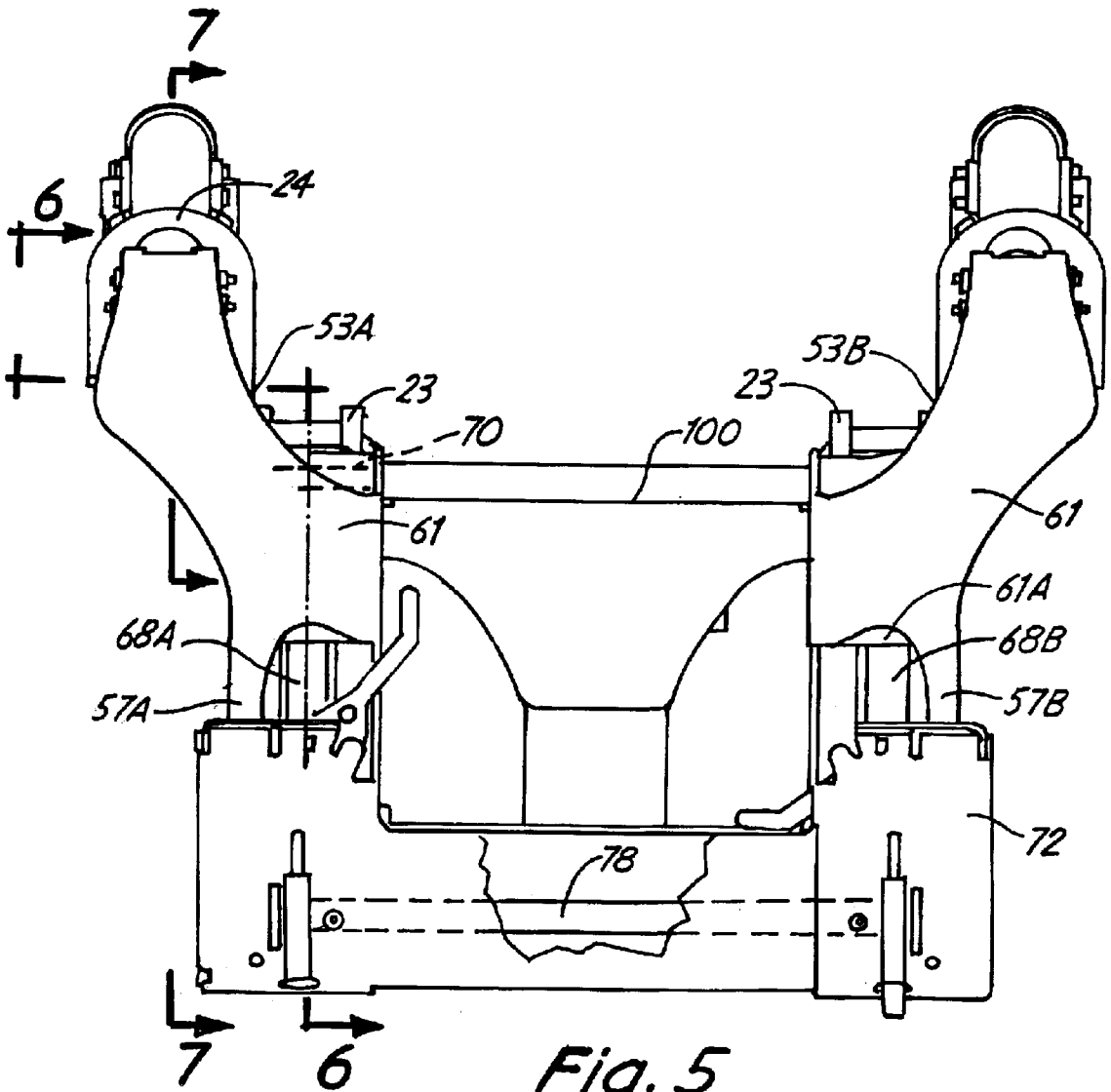
FIG. 5 is a front view of a lift arm assembly of FIG. 3 having front end frames made according to the present invention.
Figure 6:
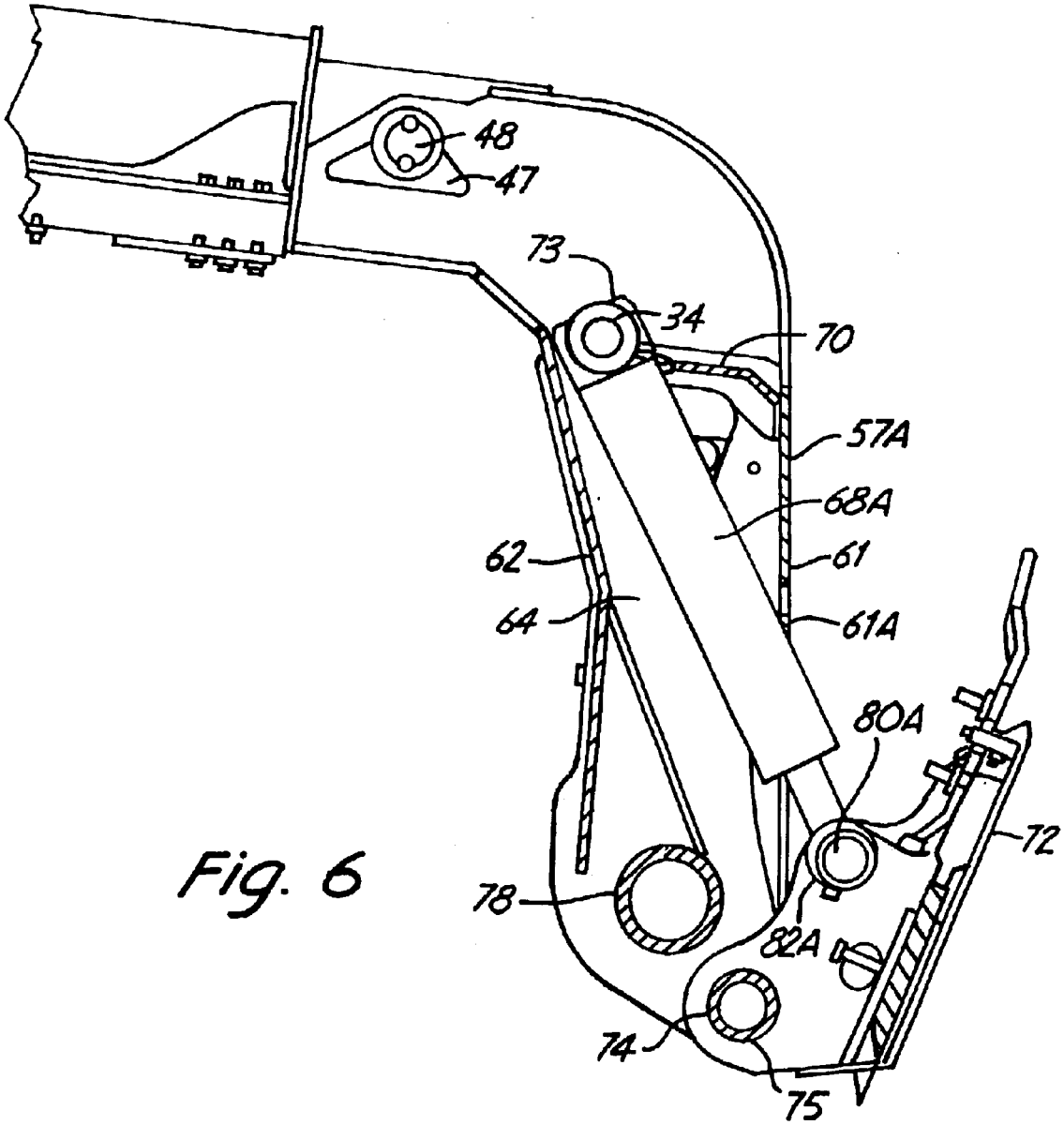
FIG. 6 is a sectional view taken on as on line 6—6 in FIG. 5 illustrating the mounting of tilt cylinders of the present invention.
Figure 7:
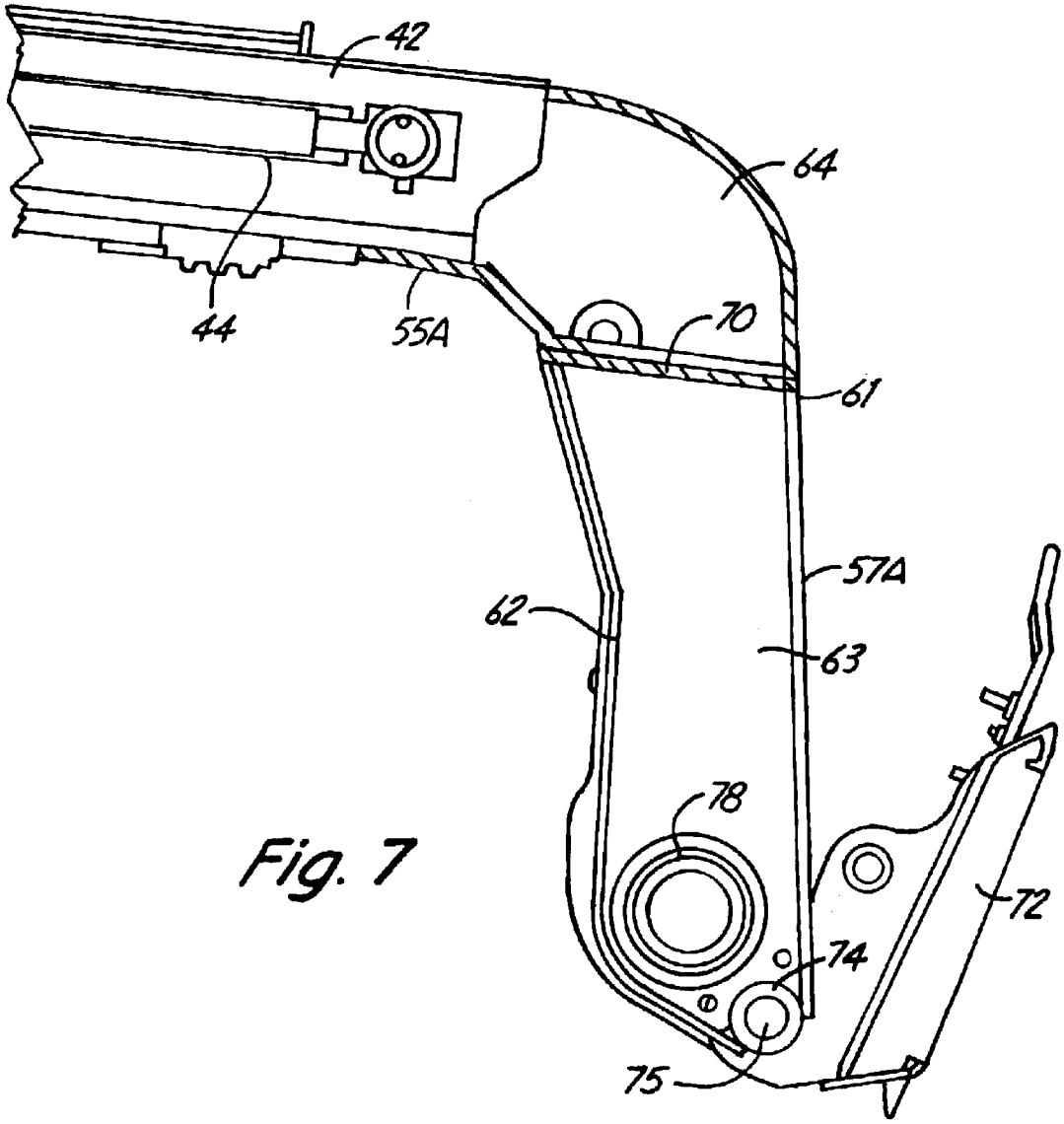
FIG. 7 is a sectional view taken as on line 7—7 in FIG. 5.

The forward lift arm frames 53A and 53B include depending or downwardly extending or depending front end lift arm frame leg sections 57A and 57B, which are formed to be offset inwardly toward the center line of the lift arm assembly from the center lines of the lift arm tubes and the socket upper ends 55A and 55B as can be seen in FIGS. 4 and 5. The depending frame leg sections 57A and 57B and the socket upper ends 55A and 55B are made into box sections, that have front and rear wall panels 61 and 62, on each of the sides, (one is right side and one is left side), and side walls 63 and 64. The frame offset leg section indicated at 57A and 57B on each of the units, has a top wall 70. Walls 70 are securely welded or otherwise fixed into the box section walls of the depending legs or sections. The trunions 73 are secured to the upper walls 70, and to other walls of the lift arm frame 53A and 53B. The tilt cylinders 68A and 68B are mounted on the trunions 73 with pins 73A. The tilt cylinders are used for pivoting the attachment plate 72 that is securely mounted on pivot pins 75 supported in the bores of spaced hubs 74 at the lower ends 76 of the respective legs 57A and 57B of the lift arm end frames. The hubs 74 are spaced apart on walls forming the depending legs of the front end frames.

The plates 70 and trunions 73 are below the lift arms, as shown in FIG. 5, to provide cab clearance for forward pivoting. The lower portions of the depending front leg sections 57A and 57B of the front end lift arm end frames 53A and 53B are joined with a rigid tubular cross member 78, that is securely welded into the side walls 64 of each depending leg section 57A and 57B. The cross member 78 extends across the respective depending leg section 57A, 57B of the lift arm end frames and is also welded into the side walls 63. The cross member 78 is a tubular structural member that will resist torsion and bending, to minimize the flexing between the lift arm tubes 42 of the inner lift arm assembly 29. In a fixed length arm assembly the lift arms or lift arm tubes can have any desired cross section that would fit into the sockets 55A and 55B on the lift arm end frames.

The tilt cylinders 68A and 68B are supported on the depending frame legs 57A and 57B at the proper spacing and are vertically aligned with the center line between the hubs 74 on each depending leg. The offset of the leg sections 57A and 57B inwardly from the lift arm tubes 42 provides clearance for tires and aligns the tilt cylinders 68A and 68B to be connectable at their rod ends indicated at 80A and 80B to hubs 82A and 82B on the standard spaced frames 83A and 83B of the tilting attachment plate 72. The pivot pins 74 for the attachment plate mount through bores in hubs 75A and 75B on the frame 83A and 83B on attachment plate 72. The pins 75 also mount in the hubs 74 on the lower ends of depending frame sections. By extending and retracting the cylinders 68A and 68B, the attachment plate 72 can be tilted about a horizontal axis.

In the form shown, the attachment plate 72 is used for mounting a loader bucket 86, of conventional design. The attachment plate 72 can be used in the same manner as the BOBTACH attachment plates sold by the Bobcat Company of Gwinner, N. Dak.

The front end frames 53A and 53B are thus separate components that are securely welded to the inner telescoping lift arm tubes 42, or to non telescoping lift arm tubes, and they are formed to have offset legs for mounting the tilt cylinders at the desired location, and spacing while providing clearance for cab pivoting at the upper ends. The spacing for cab tilting and the inwardly offset tilt cylinder mounting is clearly seen in FIG. 5.

The hydraulic tilt actuators or cylinders 68A and 68B used for controlling pivoting of the attachment plate 72, or directly tilting an attachment mounted on pins as the ends of the lift arm frames are shielded by the leg sections 57A and 57B of frames 53A and 53B. The tilt cylinders are in the box section interior. The front walls 61 of the depending frame leg sections 57A and 57B have openings 61A through which the rod ends of the tilt actuators 68A and 68B extend. The main cylinder portions of the tilt actuators are within frame sections 53A and 53B and are thus protected from impact damage.

Additionally, the end frames support an upper cross member 100. The cross member 100 does not carry loads from the tilt cylinders and can be bolted onto suitable support flanges on the depending frame leg sections, and then used for mounting hydraulic valves 102, for the hydraulic systems on attachments, and for operating the tilt cylinders 68A and 68B. Hydraulic valves 102 are provided with hydraulic fluid through the passageways in the hydraulic cylinders 44 or by separate lines from a pump on the loader. The valves 102 can be controlled by electrical signals from the main cab of the skid steer loader. Electric lines can be coiled, like a telephone handset cord, to accommodate lift arm telescoping movement. In general, the valves 102 would receive hydraulic fluid pressure from passageways in one of the cylinders 44, and the return flow back to tank would go through passageways in the other cylinder 44.

Figure 8:
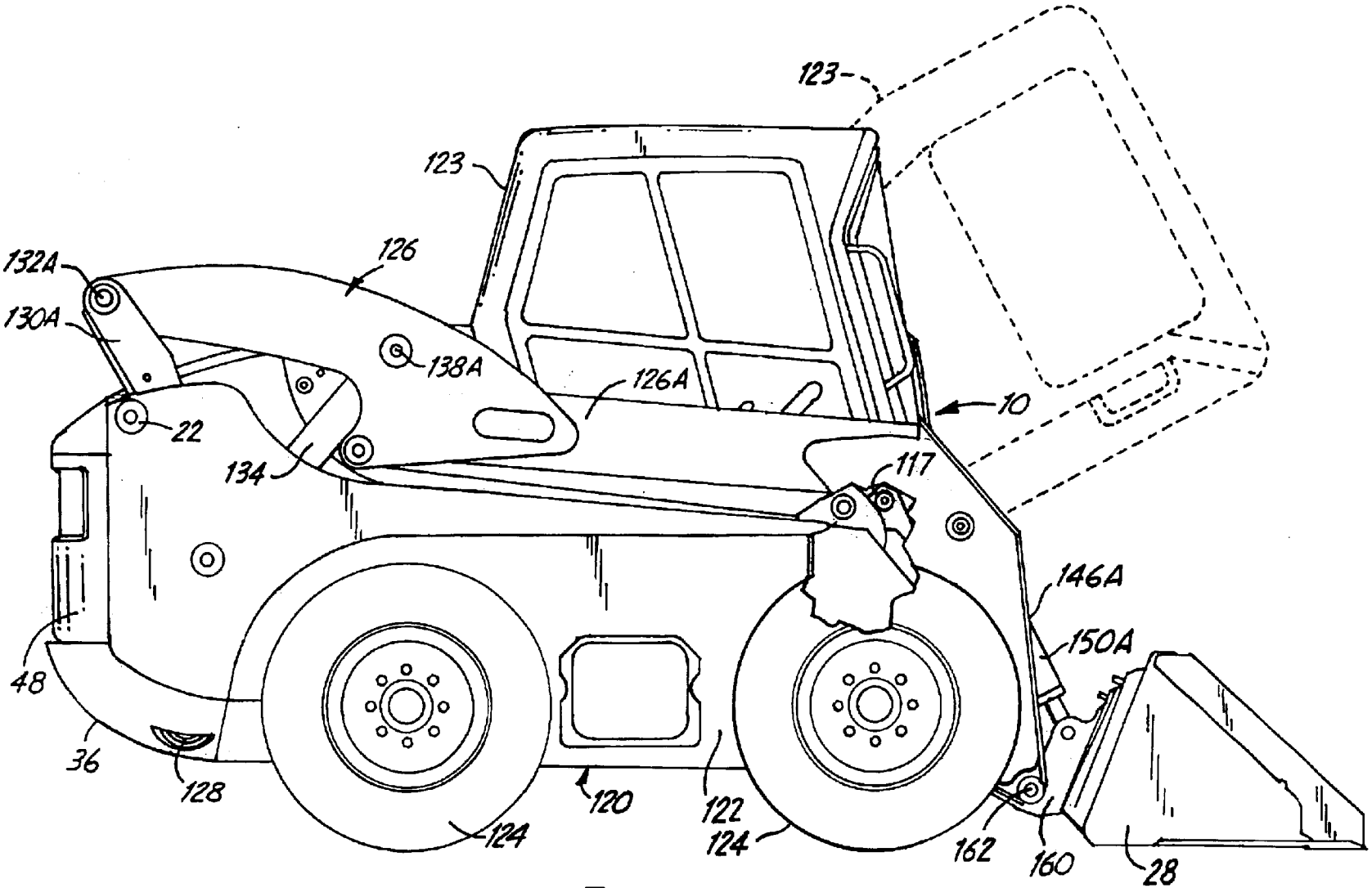
FIG. 8 is a side elevational view of a loader having a forwardly pivoting cab and a modified lift arm configuration utilizing non-telescoping lift arms.

In the second form of the invention shown in FIG. 8, a fixed length or non-telescoping lift arm assembly is illustrated.

In this form of the invention, the skid steer loader 120 has main frame 122, and support wheels 124 that are power driven to propel the loader over the ground. The loader has a forwardly pivoting cab 123 that pivots about a pivot 117 to a dotted line position, as shown in FIG. 8.

In this form of the invention, a lift arm assembly indicated generally at 126 has a base cross member support 128 (see FIG. 10) that is supported for pivoting on the frame 122 about a horizontal axis, and towards uprights 130A and 130B on opposite sides of the frame 122. Fixed length lift arms 126A and 126B are pivotally mounted at 132A and 132B at the tops of the uprights 130A and 130B. The movement of the lift arms 126A and 126B is controlled by lift cylinders 134. The lift cylinders 134 operate between pivots 136A and 136B on the uprights 130A and 130B, and join the lift arms at pivots 138A and 138B, respectively.

The lift arms 126A and 126B are spaced apart and adjacent the sides of the cab. To provide cab clearance for forward pivoting and to bring the tilt cylinders into alignment with the attachment plate mounting hubs (or direct attachment hubs) there are lift arm end frame members 140A and 140B with offset legs 146A and 146B. The lift arm end frames are right and left members, but are mirror images of each other. Lift arm front end frame members 140A and 140B have socket portions formed by flanges 142 and 144 that receive the ends of the fixed lift arms 126A and 126B. The lift arms and end frames are securely welded in place. The lift arms are formed, tubular box sections.

Figure 9:
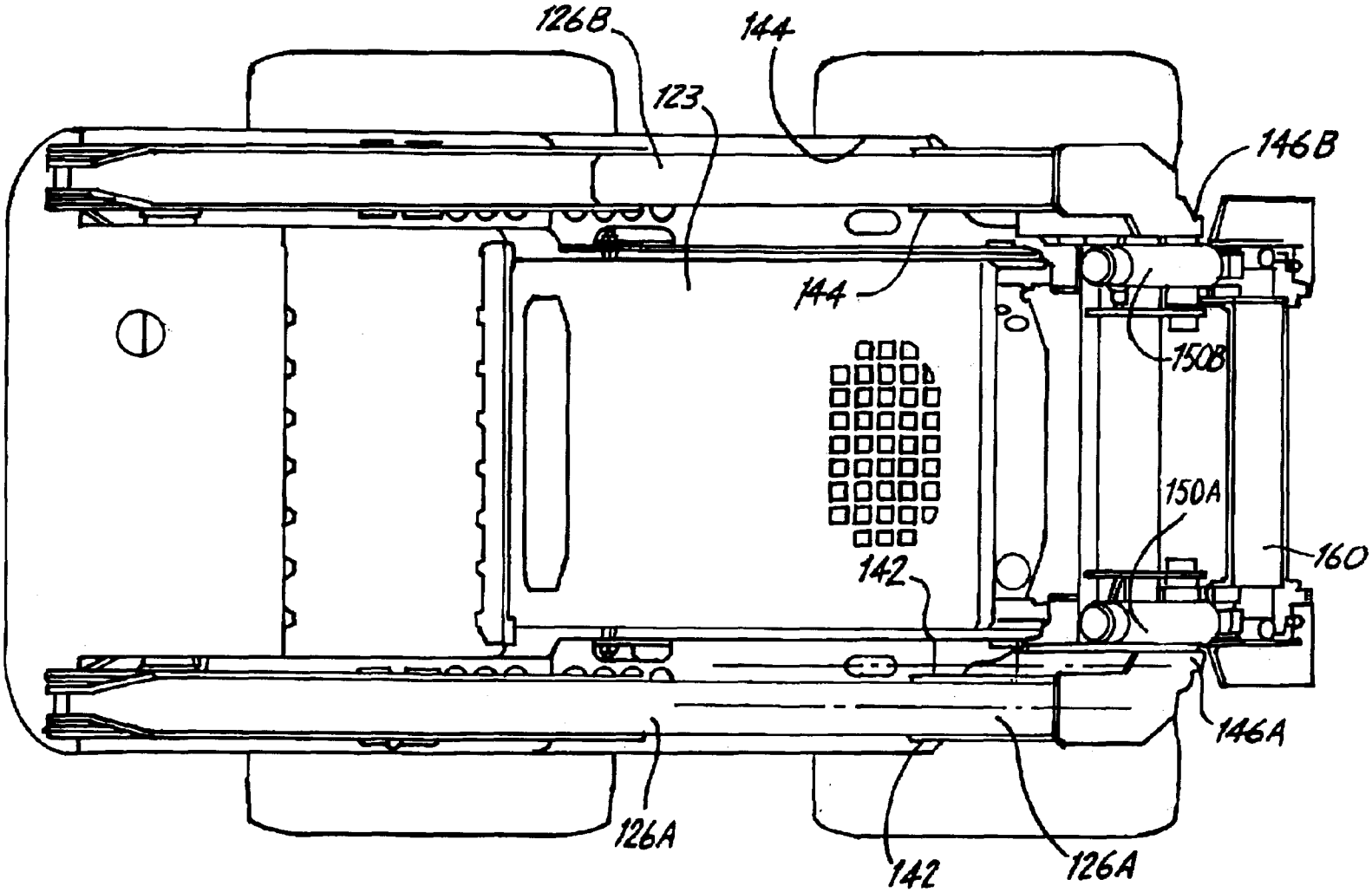
FIG. 9 is a fragmentary top plan view of the loader and lift arm assembly shown in FIG. 8.

In this form of the invention, the upper end sockets 142 and 144 have depending legs 146A and 146B, that are offset laterally inwardly from the center axis of the lift arms 126A and 126B, as can be seen in FIG. 9.

In FIG. 9, the two side plates 142 that forms sockets coupled to the lift arm 126A are shown, as are the two side plates 144 that are coupled or secured to the lift arm 126B.

The depending arms 146A and 146B are narrower than in the first form of the invention. In this form of the invention, tilt cylinders 150A and 150B for controlling a pivoting attachment plate 160 are secured with suitable supports to trunions or bushings 152A and 152B that extend through box section upper portions of the end frame members 140A and 140B, respectively. The tilt cylinders 150A and 150B are not on the interior of depending arms 146A and 146B, but are on the inner sides of the depending arms 146A and 146B to provide proper alignment with the attachment frames. The tilt cylinders extend downwardly and the rods are pivotally engaged with the tilting attachment plate 160. The attachment plate 160 is pivotally mounted on hubs 162 (See FIG. 8) on the depending arms 146A and 146B and an associate hubs 163 on each side of lift arm assembly that are secured with plates 165 to a cross tube 164. The attachment plate can be tilted about the pivot axis of these pins 162 with the tilt cylinders.

The cross tube 164 is welded to the depending arms 146A and 146B of the end frames 140A and 140B, for torsional rigidity, and hold the forward ends of the lift arms 126A and 126B in a rigid assembly through the frames 140A and 140B. The depending arms 146A and 146B are formed into box sections, at least at the lower ends, with outwardly open channels that are enclosed with plates 154 that are welded in place to form box sections. The tube 164 extends through the inner walls of the depending arms and through the plates 154 and is securely welded to both walls of each depending arm for rigidity.

The cross tube 164 also can be braced with gussets 170, from the opposite sides of the depending arms, to provide for additional rigidity.

Figure 10:
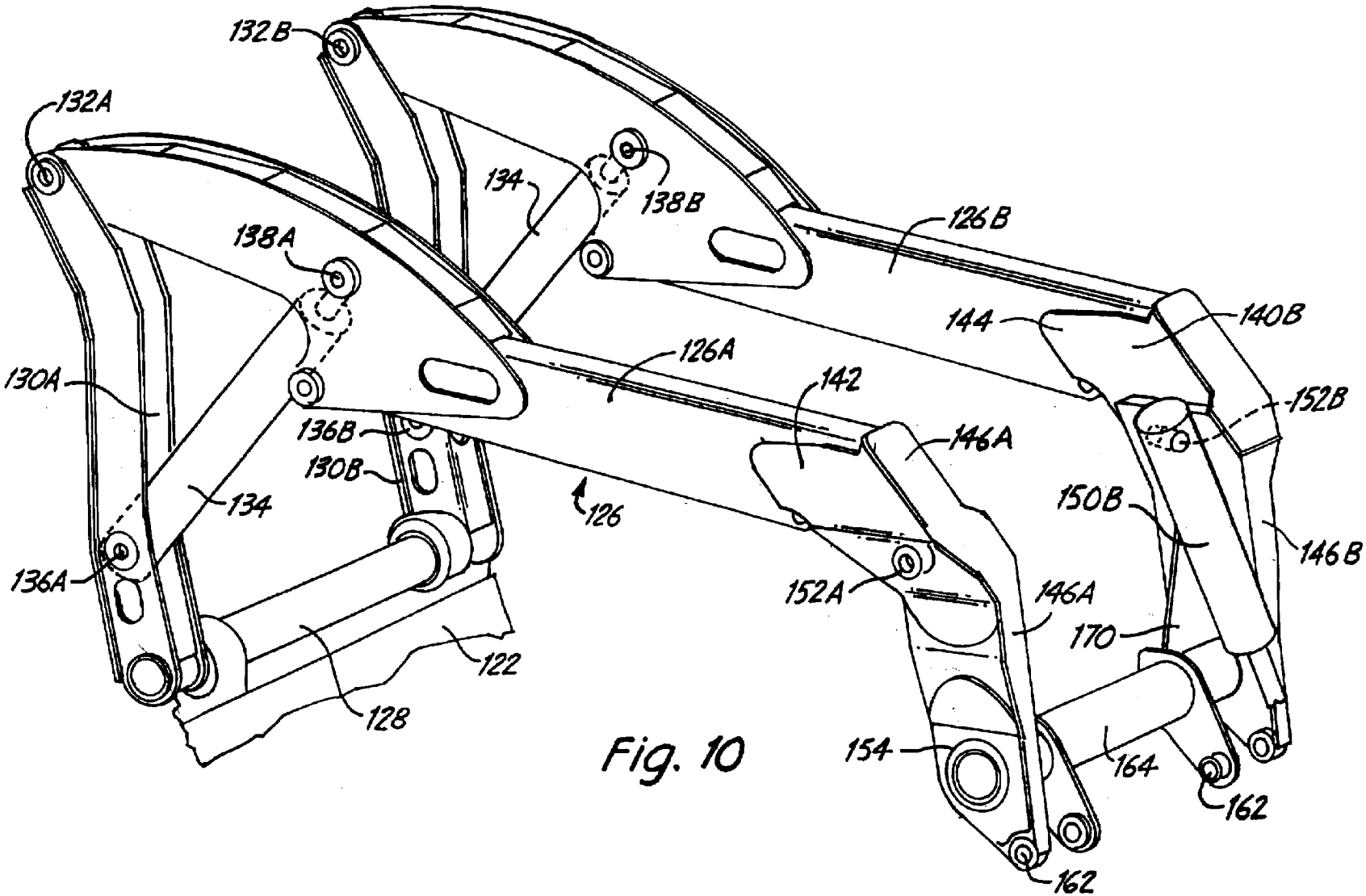
FIG. 10 is a perspective view of the lift arm assembly of FIG. 9 removed from the loader frame.

The form of the invention shown in FIGS. 8–10 shows that the front end frames are spaced at the upper end in alignment with the lift arms and provide offset tilt cylinder mounts, as can be seen in FIGS. 9 and 10. This moves the tilt cylinders above the supports for the attachment plate and at a standard spacing.

As shown in the first form of the invention, an upper cross member can be used for supporting a hydraulic valve for operating the tilt cylinders, or auxiliary equipment mounted on the tilting attachment plate 160.

The front end lift arm frames insure a rigid assembly of the lift arm tubes without a plurality of cross members, including one for a tilt. The upper ends of the front end frame arms provide sockets for receiving the lift arm tubes, either fixed or telescoping, and provide rigid supports for tilt cylinders. The box sections and in the first form of the invention also permit the tilt cylinders to be inside a housing that provide protection from external objects hitting the cylinders. The loads from tilting forces on the bucket are carried to the lift arm tubes through the box section frames of the offset leg sections, for reacting tilt cylinder forces. The lower cross members and the protective sections around the tilt cylinders are out of the way for aiding operator visibility. The front lift arm end frames support a conventional attachment plate as shown. The front end lift arm frames can be fabricated, or can be partially cast with welded on panels.

Although the present invention has been described with reference to preferred embodiments, workers skilled in the art will recognize that changes may be made in form and detail without departing from the spirit and scope of the invention.

What is claimed is:

1. A lift arm assembly for a loader comprising a lift arm having a pivot at one end for mounting to a loader frame, and having a substantially straight length to a second end, a front end lift arm frame secured to the second end of the lift arm and having a depending portion, an attachment pivot pin at a lower end of the depending portion for mounting attachments, and the depending portion being offset inwardly of the lift arm toward a center plane of the loader, the front end lift arm frame having an upper portion forming a socket for receiving the second end of the lift arm and having a tilt cylinder support at an upper end of the offset depending portion in alignment with the attachment pivot pin, the offset depending portion being below the second end of the lift arm including the tilt cylinder support, and the socket being secured to the tilt cylinder support, the tilt cylinder support including a pivot for a tilt cylinder.

2. The lift arm assembly of claim 1, wherein the depending portion has an open center with a front wall, the front wall having an opening through which a cylinder mounted on the tilt cylinder support can pass.

3. The lift arm assembly of claim 1, wherein the tilt cylinder support is below a longitudinal axis of the lift arm and wherein a tilt cylinder mounted on the support is in alignment with the offset depending portion.

4. A lift arm assembly for a loader comprising a lift arm having a pivot at one end for mounting to a loader frame, and having a substantially straight length to a second end, a front end lift arm frame secured to the second end of the lift arm and having a depending portion, an attachment pivot at a lower end of the depending portion for mounting attachments, and the depending portion being offset inwardly of the lift arm toward a center plane of the loader and having a tilt cylinder support at an upper end of the offset depending portion in alignment with the attachment pivot, the offset depending portion being below the second end of the lift arm, and wherein the depending portion is formed as a box section having a pair of side plates for at least a portion of the depending portion, a front wall, and a rear wall, joined together to form the box section, the side plates and the front and rear walls being secured to the tilt cylinder support.

5. The lift arm assembly of claim 4, wherein the box section has an interior of size to receive a tilt cylinder, the front plate of the box section having an opening for the tilt cylinder to pass therethrough for connection to a tilting member mounted on a pivot connection at the lower end of the depending frame section.

6. A lift arm assembly and loader combination or a loader having a frame, a cab that pivots forwardly pivotally mounted to a forward end of the frame, the lift arm assembly comprising a pair of lift arms that are spaced apart and extend generally parallel to each other, said lift arms being spaced and pivotally mounted on the frame along sides of the cab for movement about pivots at first ends of the lift arms, said lift arms having second ends at a forward end of the loader, and a front frame assembly secured to the second ends of the lift arms and positioned forwardly of the forward end of the loader frame, said front frame assembly including a pair of lift arm front end frames each secured to a respective lift arm, and each front end lift arm frame having a depending portion, said depending portions being offset from the lift arms toward a central plane between the lift arms, the depending portions having pivotal mountings at their lower ends for mounting attachments thereto, said depending portions comprise box cross sections having front and rear walls and side walls, the side walls being spaced apart, and a cross member being secured to both of the side walls and passing across the space therebetween on each of the depending portions, and wherein the offset depending portions have top plates secured to sockets that receive the respective lift arms, the top plates being secured to the front, rear, and side walls forming the box sections of the depending portions, and the top plates having pivot mountings thereon for supporting tilt cylinders, and the depending portions having upper ends positioned below a level of the lift arms with the lift arms lowered to provide clearance for the cab when the cab is pivoted forwardly.

7. The lift arm assembly of claim 6 and cross tube at the lower ends of the depending portions to join the lift arm front end frames together.

8. The lift arm assembly of claim 6, wherein said front walls of said depending portions have openings through which end portions of tilt cylinders supported on the tilt cylinder pivots of the respective plates can pass.

9. The lift arm assembly of claim 6, wherein said lift arms comprise telescoping tubes supported in outer housings, the outer housings providing the pivotal mounting for the lift arms to the loader frame.

10. In combination, a self-propelled loader having a frame for supporting a lift arm assembly, an operator's cab pivotally mounted on the frame for pivoting forwardly of a forward end of the frame, the lift arm assembly being pivotally mounted on rear portions of the loader frame, said lift arm assembly including a pair of lift arms that extend from pivots located at first ends of the lift arms to second ends thereof, the second ends being adjacent the forward end of the loader frame, a front end frame assembly for the lift arms, including a pair of front end frames, each secured to the second end of one of the respective lift arms, said front end frames having depending portions extending downwardly from a plane passing through central axes of both of the lift arms and offset from the lift arms toward a center of the loader frame, supports for tilt cylinders adjacent upper portions of the depending portions, the supports for the tilt cylinders being spaced downwardly from the plane, the portions of the front frame members above the supports being spaced less than the spacing between the lift arms, wherein the depending portions are formed by generally rectangular box cross shaped sections which form housings, said housings each having a pair of spaced side walls, and front and rear walls secured to the spaced side walls, a cross member passing through the box sections and being secured to both of the side walls of the depending portions of both of the depending portions, and wherein the front walls of the depending portions have openings for permitting a tilt cylinder secured to pivots on the supports to extend through the front walls of the depending portions.

11. The combination of claim 10, wherein the cross member is a circular cross section tube.

* * * * *

UNITED STATES PATENT AND TRADEMARK OFFICE

CERTIFICATE OF CORRECTION

PATENT NO. : 6,860,707 B2
DATED : March 1, 2005
INVENTOR(S) : Roan et al.

It is certified that error appears in the above-identified patent and that said Letters Patent is hereby corrected as shown below:

Column 7,
Line 29, after “arm” insert -- and --.

Column 17,
Line 61, “or” should be -- for --.

Column 8,
Line 25, after “and” insert -- a --.

Signed and Sealed this

Thirteenth Day of December, 2005

JON W. DUDAS
*Director of the United States Patent and Trademark Office*